US005707201A

United States Patent [19]

Hamlik

[11] Patent Number: 5,707,201

[45] Date of Patent: Jan. 13, 1998

[54] FORKLIFT TRUCK SIDE SHIFTER

[75] Inventor: Jim D. Hamlik, Vancouver, Wash.

[73] Assignee: Rightline Equipment, Inc., Rainier, Oreg.

[21] Appl. No.: 628,945

[22] Filed: Apr. 8, 1996

Related U.S. Application Data

[63] Continuation-in-part of Ser. No. 366,005, Dec. 28, 1994, abandoned, which is a continuation of Ser. No. 898,932, Jun. 11, 1992, abandoned.

[51] Int. Cl.[6] ..... B66F 9/14; F15B 9/10

[52] U.S. Cl. ..... 414/668; 414/671; 91/384; 91/508; 91/533

[58] Field of Search ..... 414/659, 642, 414/662, 663, 621, 607, 667, 671, 632–633; 91/170 R, 206, 508, 533; 92/61, 62, 72, 162, 175

[56] References Cited

U.S. PATENT DOCUMENTS

| | | | |
|---|---|---|---|
| 404,472 | 6/1889 | Dunn | 91/533 |
| 3,166,207 | 1/1965 | Quayle . | |
| 3,227,299 | 1/1966 | Draxler . | |
| 3,241,698 | 3/1966 | Krett . | |
| 3,356,241 | 12/1967 | Varilek | 414/671 |
| 3,726,186 | 4/1973 | Wheeeler et al. | 91/384 |
| 3,734,327 | 5/1973 | Ellis, Jr. | 414/667 |
| 3,819,078 | 6/1974 | Walsh . | |
| 4,125,199 | 11/1978 | Abels et al. | 414/671 |
| 4,165,008 | 8/1979 | Faust et al. | 414/750 |
| 4,392,772 | 7/1983 | Reeves | 414/667 |
| 4,406,575 | 9/1983 | Gaibler | 414/667 |
| 4,505,635 | 3/1985 | Shinoda et al. | 414/667 |
| 4,607,997 | 8/1986 | Asano | 414/667 |
| 5,033,934 | 7/1991 | Emilio | 414/667 |

FOREIGN PATENT DOCUMENTS

| | | | |
|---|---|---|---|
| 2 306 931 | 11/1976 | France | 414/667 |
| 1 012 259 | 7/1957 | Germany | 414/621 |
| 2 317 758 | 10/1974 | Germany | 414/667 |
| 2 716 704 | 10/1978 | Germany | 414/667 |

OTHER PUBLICATIONS

Brudi Equipment, Inc., brochure (4 pp.), "Side Shifters—It's Just That Simple" (May 1988).

Cascade Brochure (2 pp.), "E–Series Sideshifters—Cascade Announces the Sideshifter That Comes with a View".

Bolzoni, Inc., brochure (1 pg.).

Rightline Equipment, Inc., brochure (2 pp.), "Side Shifters" (May 1991).

Cascade brochure (4 pp.), "Quick–Mount Shideshifters" (Jun. 1985).

Engineering drawing of Loron, Inc. Side Shifter part No. 100152.

*Primary Examiner*—Karen B. Merritt

*Assistant Examiner*—R. B. Johnson

*Attorney, Agent, or Firm*—Klarquist Sparkman Campbell Leigh & Whinston, LLP

[57] ABSTRACT

A removable side shifter attachment attachable to the carriage bar of a lift truck has a frame shiftable with respect to the truck. The frame includes a shifter carriage bar for receiving a lift fork. A hydraulic cylinder attached to the truck carriage bar having rods contacting the frame at its sides is positioned horizontally forwardly of the truck carriage bar and between the truck carriage bar and the shifter carriage bar. The cylinder is positioned generally within a J-shaped portion of the shifter carriage bar so that the cylinder does not extend substantially above or below the carriage bar and does not appreciable add to the overall thickness of the apparatus. The cylinder further includes two axially aligned chambers separated by a central partition, each chamber containing a piston in contact with a respective rod, each piston dividing its respective chamber into interior and exterior portions. Hydraulic fluid introduced under pressure into the interior portion of one chamber and the exterior portion of the other chamber causes each of the pistons to generate an independent force to shift the frame laterally to one or the other side of the carriage bar. This effectively doubles the shifting force for a given hydraulic pressure with a given diameter cylinder.

1 Claim, 8 Drawing Sheets

FORKLIFT TRUCK SIDE SHIFTER

This application is a continuation-in-part of my application Ser. No. 08/366,005, filed Dec. 28, 1994, now abandoned which is a continuation of my application Ser. No. 07/898,932, filed Jun. 11, 1992, now abandoned.

TECHNICAL FIELD

This invention relates generally to load carrying apparatus and, more particularly, to side shifters for use with forklift trucks.

BACKGROUND OF THE INVENTION

Material handling vehicles such as forklift trucks are used to pick up and deliver loads between stations. A forklift truck typically has a mast, which supports a load lifting carriage that can be raised along the mast. The carriage normally carries a pair of forks that are maneuverable beneath the load prior to lifting the load.

For a variety of well-known reasons, it is desirable to be able to displace the forks laterally with respect to the carriage. For example, as the truck approaches a load, the forks may not be properly aligned with the load to be maneuvered under it. Rather than moving the entire truck, it may be preferable laterally to reposition the forks along the carriage.

A typical side shifter uses hydraulics for laterally displacing the forks with respect to the center line of the vehicle. The vehicle normally includes a truck carriage bar, which is fixed on the mast against lateral displacement, and the side shifter typically includes a shifter carriage bar, which is moveable laterally with respect to the truck carriage bar. The forks are mounted on the shifter carriage, and an hydraulic cylinder connecting the truck carriage bar to the shifter carriage provides the shifting action.

Currently available side shifters have several disadvantages. First, the overall thickness of the shifter locates the forks and the load away from the vehicle by an excessive amount, undesirably increasing the load moment constant. This problem is due to the thickness of the cylinder and any members that may be positioned forward of the cylinder.

A second disadvantage of prior art systems is found in those systems seeking to minimize the lost load and to decrease the effective thickness of the apparatus by positioning the shifter cylinder vertically above or below the shifter carriage bar. This permits the shifter carriage bar to be positioned closer to the main carriage bar. However, the exposed cylinder and attached elements are vulnerable to damage by shifting loads. Moreover, operational safety and efficiency may be compromised because the cylinder may block the operator's forward view when the carriage is raised into certain positions. While such view is necessarily blocked by the truck carriage bars, the cylinder itself blocks an additional portion of the operator's view.

A third disadvantage of prior systems is that the cylinders typically employed provide a limited shifting force for a given diameter, thus limiting the size of the load that may be shifted. Alternatively, a large diameter cylinder may be used, but this tends to increase the effective thickness of the apparatus regardless of where the cylinder is placed and blocks the operator's view even more than does a narrow cylinder.

SUMMARY OF THE INVENTION

Because of the foregoing problems with existing side shifter mechanisms, there is a need for an effective system that overcomes such problems. This, therefore, is the primary objective of the present invention.

Other important objects of the inventions are to provide:

- a side shifter system as aforesaid having a limited effective thickness;
- a system as aforesaid that does not excessively block the vehicle operator's forward view;
- a system as aforesaid in which the hydraulic cylinder is protected against damage;
- a system as aforesaid for providing a large lateral shifting force with a limited diameter cylinder.

According to the illustrated embodiment of the present invention, the primary objects are achieved by providing a removable side shifter attachment attachable to the carriage bar of a lift truck and having a frame comprising a shifter carriage bar that is shiftable with respect to the truck and is adapted to receive the lift forks. The shifter carriage bar comprises a member with a cross-section having a portion disposed forwardly of the truck carriage bar.

A fluid pressure actuator is operably connectable between the frame and the truck carriage bar for shifting the frame relative thereto. The actuator comprises a single cylinder having a fluid chamber positionally fixed to the truck carriage bar. The actuator is disposed between the truck carriage bar and the portion of the shifter carriage bar disposed forwardly of the truck carriage bar. At least a portion and preferably the entire fluid chamber is disposed horizontally forwardly of the truck carriage bar, that is within the horizontal projections of the truck carriage bar, and horizontally rearwardly of the portion of the shifter carriage bar disposed forwardly thereof. Such positioning protects the actuator from damage. Furthermore, inasmuch as the cylinder does not extend above or below the truck carriage bar, it minimizes interference with the truck operator's forward view.

The cylinder desirably comprises two separate chambers laterally separated by a partition preventing fluid communication therethrough. A piston is received in each chamber. The fluid connections are arranged such that the pistons act in concert, thereby to achieve a greatly increased shifting force over that which would be possible with a cylinder of the same diameter having only one piston. This permits use of a lesser diameter cylinder than has been heretofore possible, thereby to decrease the effective thickness of the apparatus, thus minimizing the load moment constant, and otherwise assist in achieving the objects of the invention.

DESCRIPTION OF THE FIRST EMBODIMENT

Figure 1:
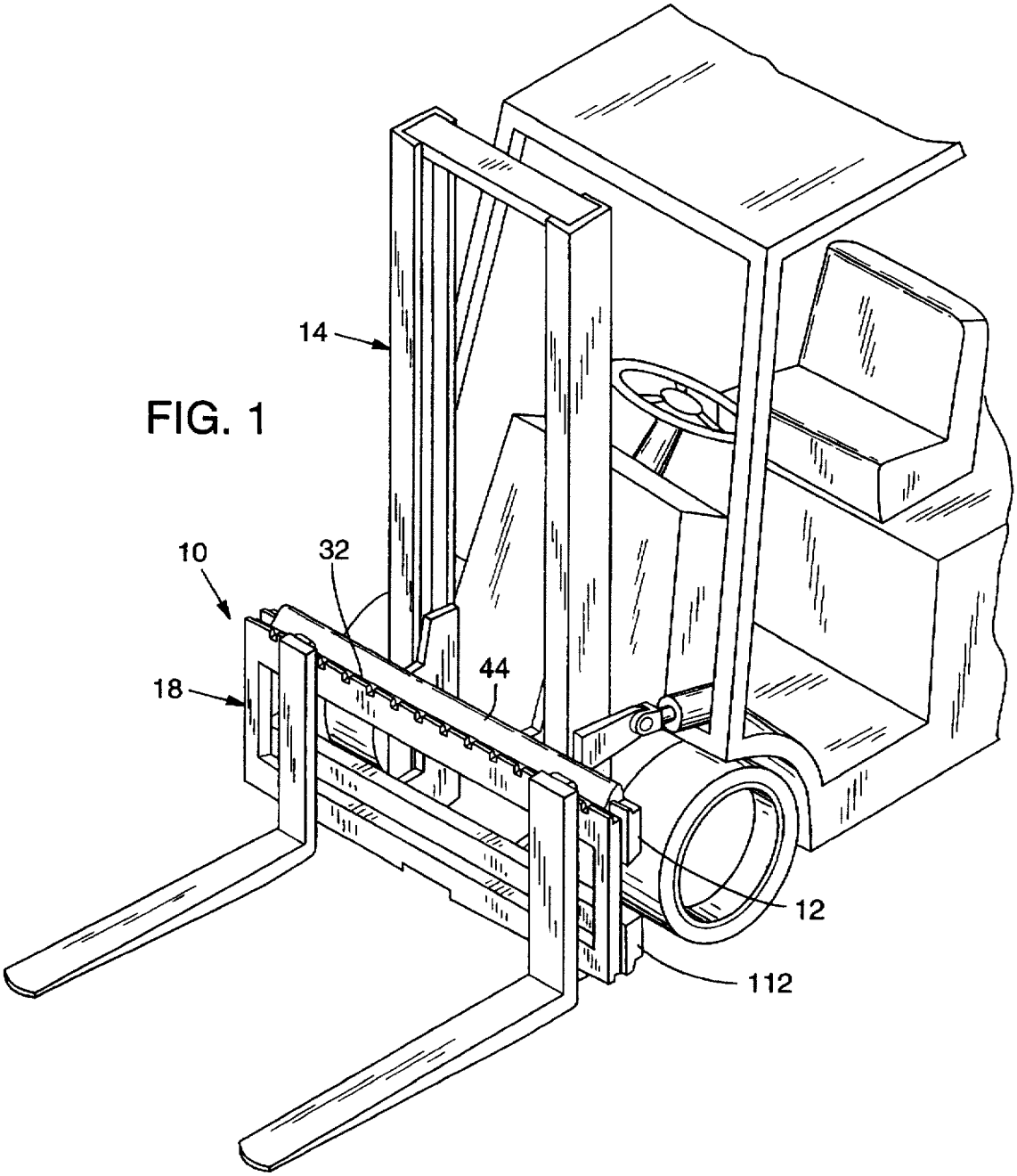
FIG. 1 is front perspective view of the invention illustrated attached to a lift truck.

FIG. 1 shows a side shifter apparatus 10 removably suspended from an upper truck carriage bar 12 of a lift truck 14. Side shifter 10 includes a rectangular frame 18 oriented generally vertically and positioned immediately forward of truck carriage bar 12. As will be discussed below, frame 18 is laterally shiftable relative to truck carriage bar 12.

Figure 2:
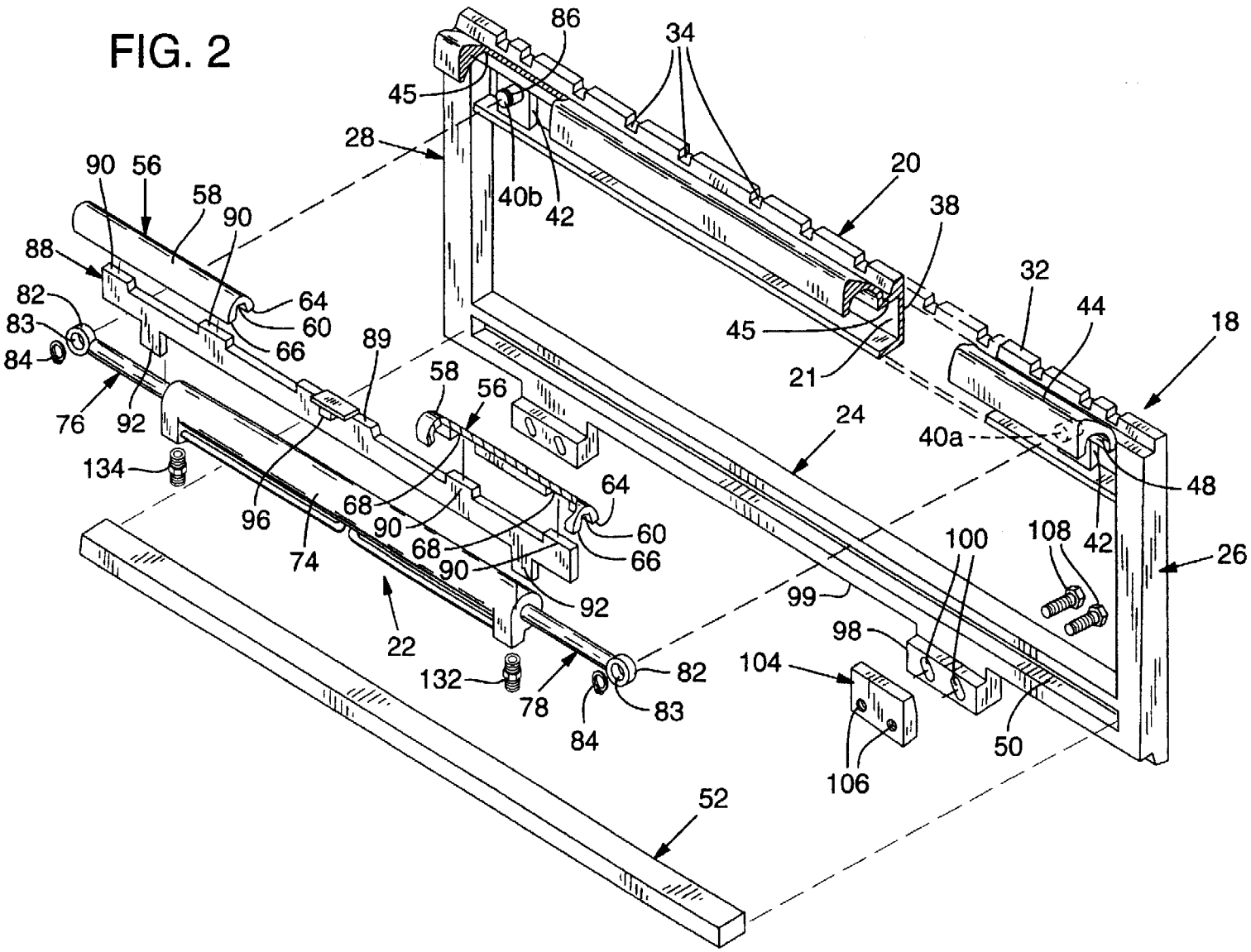
FIG. 2 is an exploded isometric rear view of one embodiment of the invention generally illustrated in FIG. 1.

As shown in FIG. 2, frame 18 includes an upper shifter carriage bar 20 having a recessed channel 21 for protectively receiving an hydraulic actuator 22 such that actuator 22 does not protrude above or below bar 20, and such that actuator 22 is protected against damage without substantially increasing the effective thickness of apparatus 10.

Figure 4:
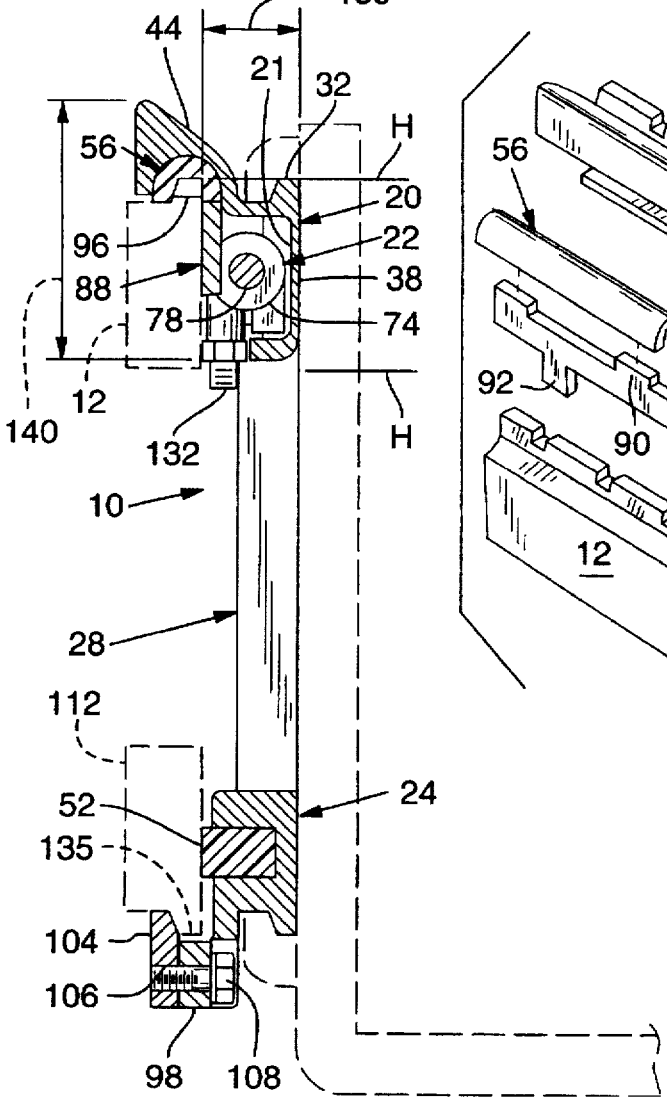
FIG. 4 is a cross-sectional side view taken along line 4—4 of FIG. 3.

Upper shifter carriage bar 20 of frame 18 is oriented horizontally, with a lower shifter carriage bar 24 spaced vertically below upper bar 20. A vertically oriented right side bar 26 and an opposed left side bar 28 are connected to the ends of bars 20, 24 to form frame 18. Upper shifter carriage bar 20 includes an upwardly projecting lip 32 at the upper side and forward edge thereof. Lip 32 is suitable for engaging a standard fork upright, being provided with a number of registration notches 34 for registering with a standard lift fork. Upper shifter carriage bar 20 is substantially hollowed-out, defining rearwardly open channel 21 along substantially the entire length of the bar. The lower portion of bar 20 is generally J-shaped, as can be seen in FIG. 4. Consequently, a thin vertical web 38 remains to provide a protective guard wall at the front surface of bar 20. A pair of attachment bosses 40*a*, 40*b*, are provided near each end of channel 21. Each of attachment bosses 40*a*, 40*b* includes a reinforcing plate 42 abutting web 38 to provide an increased cross sectional thickness so that forces applied to bosses 40*a*, 40*b* are distributed over a wider area of shifter bar 20, thereby to avoid damage to web 38.

A suspension element is provided by a downwardly open, elongated overhang 44 attached along its forward edge to an upper rear edge 45 of upper shifter carriage bar 20. Overhang 44 has a smooth semi-cylindrical interior surface 48, and is preferably integral with bar 20 such that it may support the entire weight of the frame, forks, and any load carried thereon.

Lower shifter carriage bar 24 defines a rearwardly open rectangular pocket 50 running substantially the entire length of bar 24. Pocket 50 closely receives an elongated, low friction plastic rub bar 52 partially protruding therefrom. Where additional torsional strength is required, pocket 50 may be eliminated, so that shifter carriage bar 24 is solid, with thin bearing sheets (not shown) attached to the rear thereof.

A pair of solid plastic semi-cylindrical bearings 56 are provided to rest in a stationary position on truck carriage bar 12, slidably to support overhang 44 of bar 20, as further shown in FIG. 4. As shown in FIG. 2, each bearing 56 comprises an elongated body having an upper cylindrical surface 58 smoothly curved to conform to interior surface 48 of overhang 44. An elongated groove 60 is defined in the lower surface of each bearing 56, and is shaped and sized closely to receive the upper lip 59 of upper truck carriage bar 12. See FIG. 5. Consequently, each bearing 56 has a generally inverted U-shaped cross-section, with a downwardly depending front leg 64 positioned toward the front end of the apparatus, and a rear leg 66 positioned toward lift truck 14. Front leg 64 of each bearing 56 further defines a pair of spaced-apart rectangular notches 68. See FIG. 2.

Actuator 22 comprises an elongated cylinder 74 having piston rods 76, 78 extending from opposite ends thereof, and is positioned substantially within channel 21, horizontally forwardly of truck carriage bar 12, that is, within the horizontal projections H of the upper and lower surfaces of truck carriage bar 12, and rearwardly of web 38 of upper shifter bar 20, as clearly shown in FIG. 4. Cylinder 74 does not extend vertically above the upper surface of overhang 44 of shifter bar 20, nor above upper lip 32 of shifter bar 20, nor above upper lip 59 of truck carriage bar 12, nor does it extend below the lower surfaces of either upper truck carriage bar 12 or upper shifter bar 20. Thus, cylinder 74 is protected by web 38 of bar 20, and this protected position also minimizes interference with the truck operator's field of view.

Figure 3:
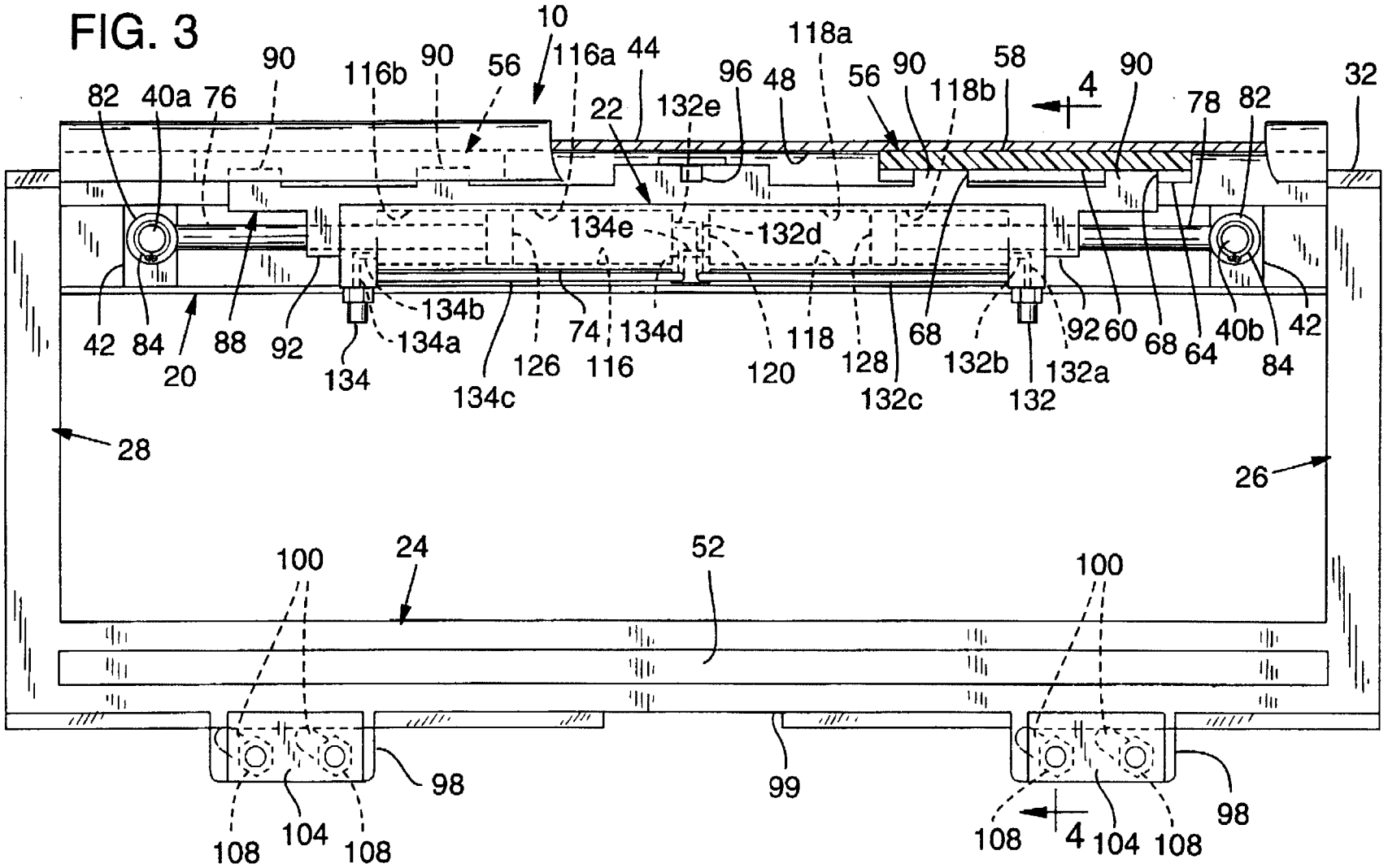
FIG. 3 is a cut-away rear view of the apparatus of FIG. 2.

Each piston rod 76, 78 includes a ring 82 attached at its free end, rings 82 each defining a bore 83 for closely receiving a respective boss 40*a*, 40*b*, as shown in FIGS. 2 and 3. A spring clip 84 retains each ring 82 securely on the respective bosses 40*a*, 40*b* by engaging a circumferential groove 86 on the boss.

Figure 5:
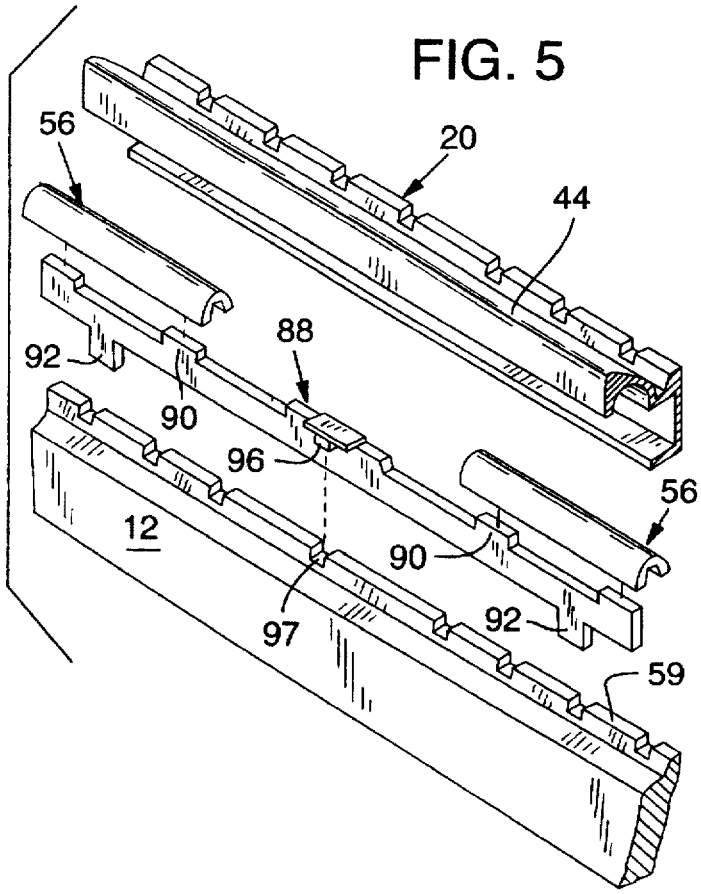
FIG. 5 is a fragmentary exploded isometric rear view of the apparatus of FIG. 2.

Referring to FIG. 2, an elongated registration bar 88 comprises a flat, metal plate having a thickness generally equal to the thicknesses of front legs 64 of bearings 56. A pair of spaced-apart rectangular bearing registration tabs 90 protrude upwardly from each end of bar 88 closely to be received within corresponding notches 68 of bearings 56. Such engagement between bar 88 and bearings 56 prevents lateral shifting therebetween. A pair of cylinder capture tabs 92 depend downwardly from bar 88, with each tab 92 located near an opposite end of the bar. Tabs 92 are spaced apart closely to receive cylinder body 74 therebetween. A central alignment key or knob 96 comprises a rectangular element protruding downwardly and rearwardly from the center of bar 88 at an upper edge 89 thereof. As shown in FIG. 5, knob 96 has a width sized to be received closely within a central alignment notch 97 in upper lip 59 of upper truck carriage bar 12. Thus, when installed as shown in FIG. 5, registration bar 88, cylinder body 74, and bearings 56 are all positionally fixed to truck carriage bar 12.

As further shown in FIG. 2, a pair of clamping feet 98 depend from a lower edge 99 of lower bar 24 of frame 18 at the rear side thereof. Each foot 98 includes a pair of parallel diagonally slanted slots 100. A clamping plate 104 defines a pair of threaded bores 106 arranged to register with slots 100 to receive threaded bolts 108 for securing each clamping plate 104 against its respective clamping foot 98. Diagonally slanted slots 100 permit vertical adjustment of plates 104 to secure them firmly against the lower truck carriage bar 112, as shown in FIG. 4. With plates 104 thus secured, key 96 is also held securely in notch 97 in upper carriage bar 12. See FIG. 5.

As shown in FIGS. 2, 3 and 4, apparatus 10 is assembled and installed so that registration bar 88, bearings 56 and cylinder body 74 remain laterally aligned as a unit and fixed relative to truck carriage bars 12 and 112. Side shifter frame 18, piston rods 76 and 78, and clamps 104 together shift laterally as a unit in response to actuation of hydraulic actuator 22, frame overhang 44 sliding laterally over fixed bearings 56.

As set forth hereinabove, actuator 22 is designed to provide substantial shifting force using only a narrow cylinder. Referring to FIG. 3, cylinder 74 comprises a left chamber 116 and a right chamber 118 laterally separated by a fixed septum or partition 120 which prevents fluid communication therebetween. Chambers 116, 118 are axially aligned in end-to-end relationship, and have the same diameter and length.

A left piston 126 is attached to left piston rod 76 to slide within left chamber 116; a right piston 128 is attached to right piston rod 78 to operate similarly in right chamber 118. Piston 126 defines chamber 116 as having interior and exterior portions 116*a* and 116*b*, respectively. Similarly, piston 128 defines chamber 118 as having interior and exterior portions 118*a* and 118*b*, respectively. Pistons 126, 128 prevent fluid communication between portions 116*a*, 116*b* and 118*a*, 118*b*, respectively.

Hydraulic fluid is introduced into chambers 116, 118 through hydraulic lines and passages as will be more fully described as follows. A first hydraulic connection 132 is provided to introduce hydraulic fluid into one side of cylinder body 74 and release fluid under pressure therefrom; and a second hydraulic connection 134 is provided to introduce hydraulic fluid into the other side of cylinder body 74 and release fluid under pressure therefrom.

Again referring to FIG. 3, application of hydraulic pressure to connection 132, with simultaneous release of pressure at connection 134, forces hydraulic fluid through passages 132*a* and 132*b* into exterior portion 118*b* of chamber 118, exteriorly of piston 128; also hydraulic fluid through exterior line 132*c* and thence through passages 132*d* and 132*e* in partition 120 into interior portion 116*a* of chamber 116, interiorly of piston 126. Fluid communication between left and right chambers 116 and 118, however, is prevented. Passages 132*d* and 132*e* in partition 120 communicate only with line portion 132*c*, which is outside chamber 118. This application and release of fluid pressure cause pistons 126 and 128 and rods 76 and 78 to act in concert or in tandem, generating independent shifting forces to shift frame 18 forcefully to the left, as shown in FIG. 3, piston 128 and rod 78 pulling on the right side of upper shifter bar 20 through boss 40*b*, and piston 126 and rod 76 pushing on the left side of bar 20 through boss 40*a*.

Similarly, application of hydraulic pressure at connection 134, with simultaneous release of pressure at connection 132, forces hydraulic fluid through passages 134*a* and 134*b* into exterior portion 116*b* of chamber 116, exteriorly of piston 126; also hydraulic fluid through exterior line 134*c* and thence through passages 134*d* and 134*e* in partition 120 into interior portion 118*a* of chamber 118, interiorly of piston 128. Again, fluid communication between left and right chambers 116 and 118 is prevented. Passages 134*d* and 134*e* in partition 120 communicate only with line portion 134*c*, which is outside chamber 116. This application and release of pressure cause pistons 126 and 128 and rods 76 and 78 also to act in concert or in tandem, generating independent shifting forces to shift frame 18 forcefully to the right as shown in FIG. 3, piston 126 and rod 76 pulling on the left side of upper shifter bar 20 through boss 40*a*, and piston 128 and rod 78 pushing on the right side of upper shifter bar 20 through boss 40*b*.

Consequently, for a given diameter cylinder, at a given hydraulic pressure, the total shifting force of pistons 126, 128 is greatly increased inasmuch as pistons 126, 128 act in concert or in tandem. The hydraulic fluid acts on each piston independently. For example, if the diameter of each of piston rods 76, 78 is one-half the diameter of pistons 126, 128, the total shifting force is increased by seventy-five per cent over that which would occur if there were only one piston because pistons 126, 128 act in tandem. If the diameter of each of piston rods 76, 78 is less than one-half the diameter of pistons 126, 128, the total shifting force generated by pistons 126, 128 acting in tandem increases in the limiting case to approximately twice that of one piston acting alone.

In this embodiment, the main structural members are formed of steel, with the bearings 56 and rub bar 52 formed of a durable low-friction plastic such as molybdenum disulfide-impregnated nylon. For weight savings, the structural components of the frame may be formed of extruded hollow tubing.

Where this first embodiment is used for Industrial Truck Association (ITA) class II carriage systems, frame 18 is 16 inches high and between 31 and 63 inches wide, with a shifting capability of 8 inches. The apparatus has a lost load or effective thickness 138 (shown in FIG. 4) equal to the distance between the front surface of shifter carriage bar 20 and the front surface of truck carriage bar 12, and which is about 2.125 inches. The overall diameter of cylinder 74 is 1.63 inches. The thickness of web 38 of upper shifter carriage bar 20 adjacent cylinder 74 is about 0.2 inches. When fabricated in accordance with the above dimensions and with a 40 inch width, the apparatus has a weight of about 110 pounds. The narrowest 31 inch width configuration requires recesses to be defined in vertical side bars 26 and 28 with attachment bosses 40*a*, 40*b* residing therein to accommodate the standard length hydraulic actuator 22.

Under ITA standards, a class II truck has a carriage height, or a distance between the lower lip 135 of lower truck carriage bar 112 and upper lip 59 of upper carriage bar 12, of 16 inches. In ITA class III, the carriage height is 20 inches; in class IV, 25 inches. Accordingly, the invention may be scaled up for the larger class systems.

Upper shifter carriage bar 20, including cylinder 74, has an effective vertical height 140 (shown in FIG. 4), defined as the vertical distance between the upper surface of overhang 44 of upper shifter carriage bar 20 and the lowest portion of bar 20, including cylinder 74 and any other opaque structure that extends a substantial horizontal distancee to obscure the operator's view, of about 3½ inches. This dimension is proportionately larger in class III and class IV systems. Effective vertical height 140 does not include any hydraulic lines, fittings or other narrow vertical objects that do not substantially obscure the view of a binocular operator.

In this first embodiment the system includes web 38 as well as the lower flange of upper shifter carriage bar 20, both of which serve to protect cylinder 74. However, it is useful to note that the lowest horizontal portion of actuator 22, which is cylinder 74, depends below the upper surface of overhang 44 of upper truck carriage 12 bar by a very limited amount, in this embodiment about 2½ inches. If the guard or web is unnecessary and is eliminated for some applications, such would permit a further reduction in effective height 140. Without such a guard, an effective actuator height of less than 3 inches might easily be achieved. Of course, these dimensions will be proportionately larger for class III and class IV systems.

In class II systems, with the effective height of the apparatus at less than 4 inches, and a carriage height of 16 inches, a visibility ratio equal to the effective height divided by carriage height will be less than ¼. This ratio and a comparable ratio for effective actuator height are applicable to all classes of forklift trucks, including classes III and IV.

The slimness of the bar and cylinder assembly may be quantified by an effective area of the apparatus equal to the product of effective height 140 and the lost load or effective thickness 138.

DESCRIPTION OF THE SECOND EMBODIMENT

FIGS. 6, 7, 8, 9 and 10 illustrate a second embodiment of my invention.

Figure 6:
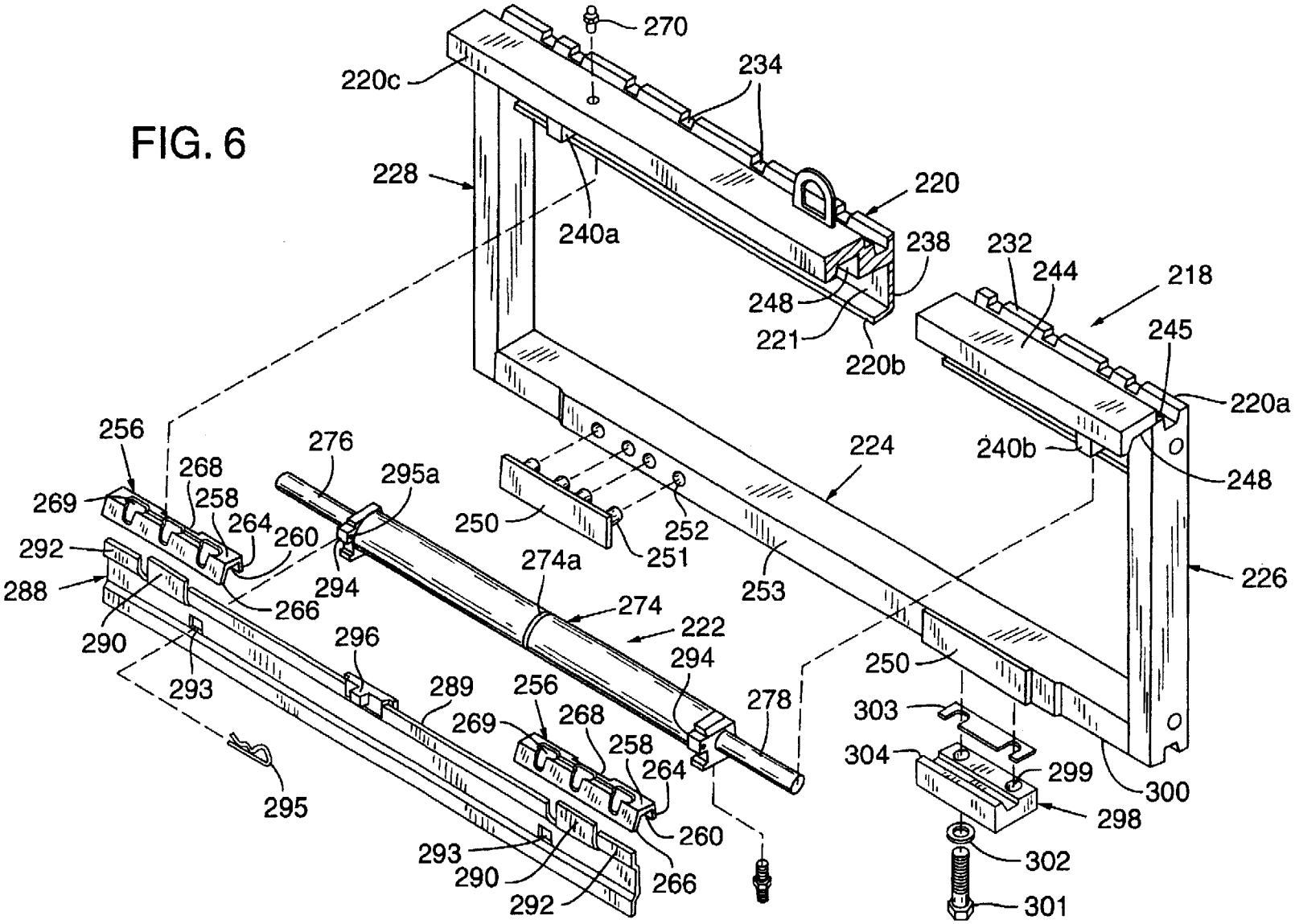
FIG. 6 is an exploded isometric rear view of a second embodiment of the invention.

As shown in FIG. 6, the second embodiment of my side shifter includes a rectangular frame 218 which is also oriented generally vertically and positioned immediately forward of truck carriage bar 12. As in the first embodiment, frame 218 is also laterally shiftable relative to truck carriage bar 12.

Frame 218 includes an upper shifter carriage bar 220 itself comprised of three elements 220*a*, 220*b* and 220*c* welded together. See FIG. 8. Elements 220*a* and 220*b* form a recessed channel 221 for protectively receiving an hydraulic actuator 222. As with the first embodiment, actuator 222 does not protrude above or below bar 220, thus being protected against damage without substantially increasing either the effective vertical height or the effective thickness of the shifter.

Upper shifter carriage bar 220 of frame 218 is oriented horizontally, and has a lower shifter carriage bar 224 spaced vertically below it. A vertically oriented right side bar 226 and an opposed left side bar 228 are connected to the ends of bars 220, 224 to form frame 218. Element 220*a* of upper shifter carriage bar 220 includes an upwardly projecting lip 232 at the upper side and forward edge thereof. Lip 232 is suitable for engaging a standard lift fork, being provided with a number of registration notches 234 for registering with the lift fork.

Figure 8:
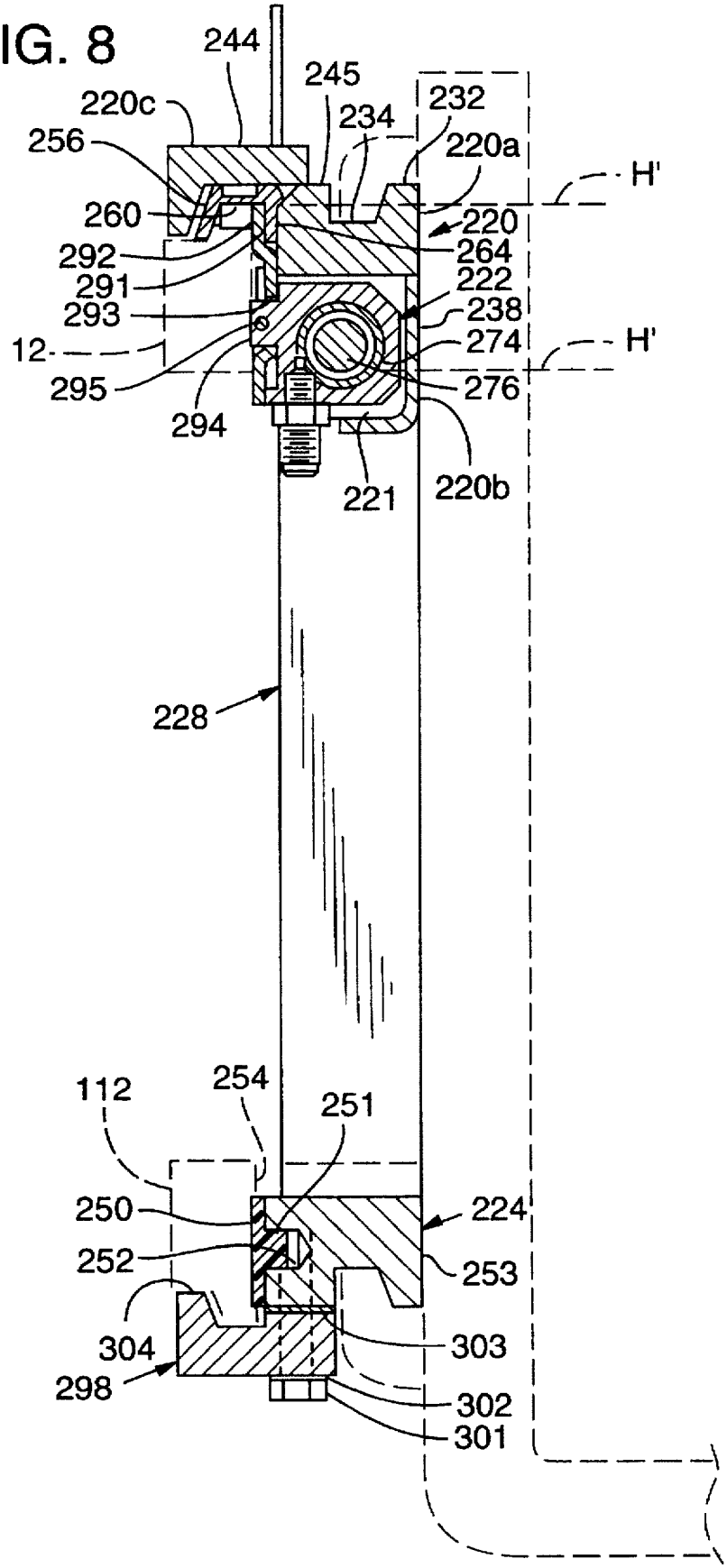
FIG. 8 is a cross-sectional side view taken along line 8—8 of FIG. 7.

Element 220*b* is formed substantially as a curved angle, as shown in FIG. 8. Thus, upper shifter carriage bar 220 has a hollowed-out construction, defining rearwardly open channel 221 along substantially its entire length. As shown in FIGS. 6 and 8, element 220*b* is substantially J-shaped and comprises a thin vertical web 238 which provides a protective guard wall at the front surface of bar 220.

A pair of abutment plates 240*a* and 240*b* are welded to the undersurface of element 220*a* of bar 220 hear each end thereof. Shifting forces exerted by actuator 222 react against plates 240*a*, 240*b* to shift frame 218, as will be more fully described hereinbelow.

Element 220*c* of upper shifter bar 220 provides a suspension element in the form of a downwardly-open, elongated overhang 244, element 220*c* being welded to the upper rear edge 245 of element 220*a* of upper shifter carriage bar 220. Overhang 244 has a smooth interior surface 248 and is capable of supporting the entire weight of the frame, forks, and any load carried thereon.

A pair of plastic rub plates 250 having molded cylindrical knobs 251 are press fit into corresponding apertures 252 drilled into the rear face 253 of lower shifter carriage bar 224. Plates 250 are adapted to make sliding contact with the front face 254 of lower truck carriage bar 112. See FIGS. 6 and 8.

A pair of generally channel-shaped metallic bearings 256 are provided to rest in a stationary position on upper truck carriage bar 12, slidably to support overhang 244 of bar 220, as further shown in FIG. 8. Bearings 256 are preferably made of aluminum bronze. As shown in FIG. 6, each bearing 256 comprises an elongated body having an upper surface 258 shaped to conform to interior surface 248 of overhang 244. The lower interior surface of each bearing 256 defines an elongated groove 260, which is shaped and sized closely to receive upper lip 59 of upper truck carriage bar 12, similarly to the first embodiment in FIG. 5.

As in the first embodiment, each bearing 256 has a generally inverted U-shaped cross-section, with a downwardly depending front leg 264 positioned toward the front end of the apparatus, and a rear leg 266 positioned toward lift truck 14. Front leg 264 of each bearing 256 further defines a rectangular notch 268. Each bearing 256 further provides three slots 269 formed in its upper surface 258 and rear leg 266 to permit the introduction of grease through fitting 270 to lubricate surfaces 258 of bearings 256 and surface 248 of overhang 244. See FIG. 6.

As in the case of the first embodiment, actuator 222 comprises an elongated cylinder 274, positioned substantially within channel 221, horizontally forwardly of upper truck carriage bar 12. As shown in FIG. 8, cylinder 274 is at least partially, and preferably substantially or wholly within the horizontal projections H' of the upper and lower surfaces of truk carriage bar 12. Cylinder 274 is also disposed rearwardly of web 238 of element 220*b* of upper shifter bar 220. Cylinder 274 does not extend vertically above the upper surface of overhang 244 of element 220*c* of upper shifter bar 220, nor does it extend above upper lip 232 of element 220*a* of bar 220, nor does it extend above upper lip 59 of upper truck carriage bar 12; nor does it extend below the lower surface of element 220*b* of bar 220. Thus, as in the case of the first embodiment, cylinder 274 is protected by web 238 of element 220*b* of bar 220, and this protected position also minimizes interference with the truck operator's field of view.

Referring to FIG. 6, an elongated registration bar 288 comprises a transversely offset member formed from a flat metal plate having a thickness generally equal to the thickness of front legs 264 of bearings 256. See FIG. 8. Bar 288 provides a pair of rearwardly laterally offset bearing registration tabs 292 to engage the rear faces 291 of front-legs 264 of bearings 256, also as shown in FIG. 8. Additionally, bar 288 provides tabs 290 to engage notches 268 in bearings 256 to prevent lateral shifting between bar 288 and bearings 256.

Bar 288 is also provided with a pair of rectangular apertures 293 which receive complementarily sized knobs 294 positioned at the ends of actuator 222. Knobs 294 are retained within apertures 293 by clips 295 received in holes 295*a* in knobs 294, thereby to fasten actuator 222 securely to bar 288.

A central alignment key or knob 296 comprising a rectangular element protrudes rearwardly from the center of bar 288 at an upper edge 289 thereof. As with the first embodiment, knob 296 has a width sized to be received closely within central alignment notch 97 in upper lip 59 of upper truck carriage bar 12. Consequently, as in the case with the first embodiment, when frame 218 is installed as shown in FIG. 5, registration bar 288, cylinder 274, and bearings 256 are all positionally fixed to truck carriage bar 12.

As further shown in FIG. 6, a pair of clamping feet 298 are bolted through a pair of bolt holes 299 to the bottom surface 300 of lower shifter carriage bar 224 by bolts 301 using washers 302. Clamping feet 298 are positioned immediately below plastic rub plates 250, their vertical positions being adjusted by shims 303. By this means the rearward edge 304 of each clamping foot 298 is secured firmly against the lower truck carriage bar 112, as shown in FIG. 8. With clamping feet 298 thus secured, knob 296 is held securely in notch 97 in upper carriage bar 12.

Figure 7:
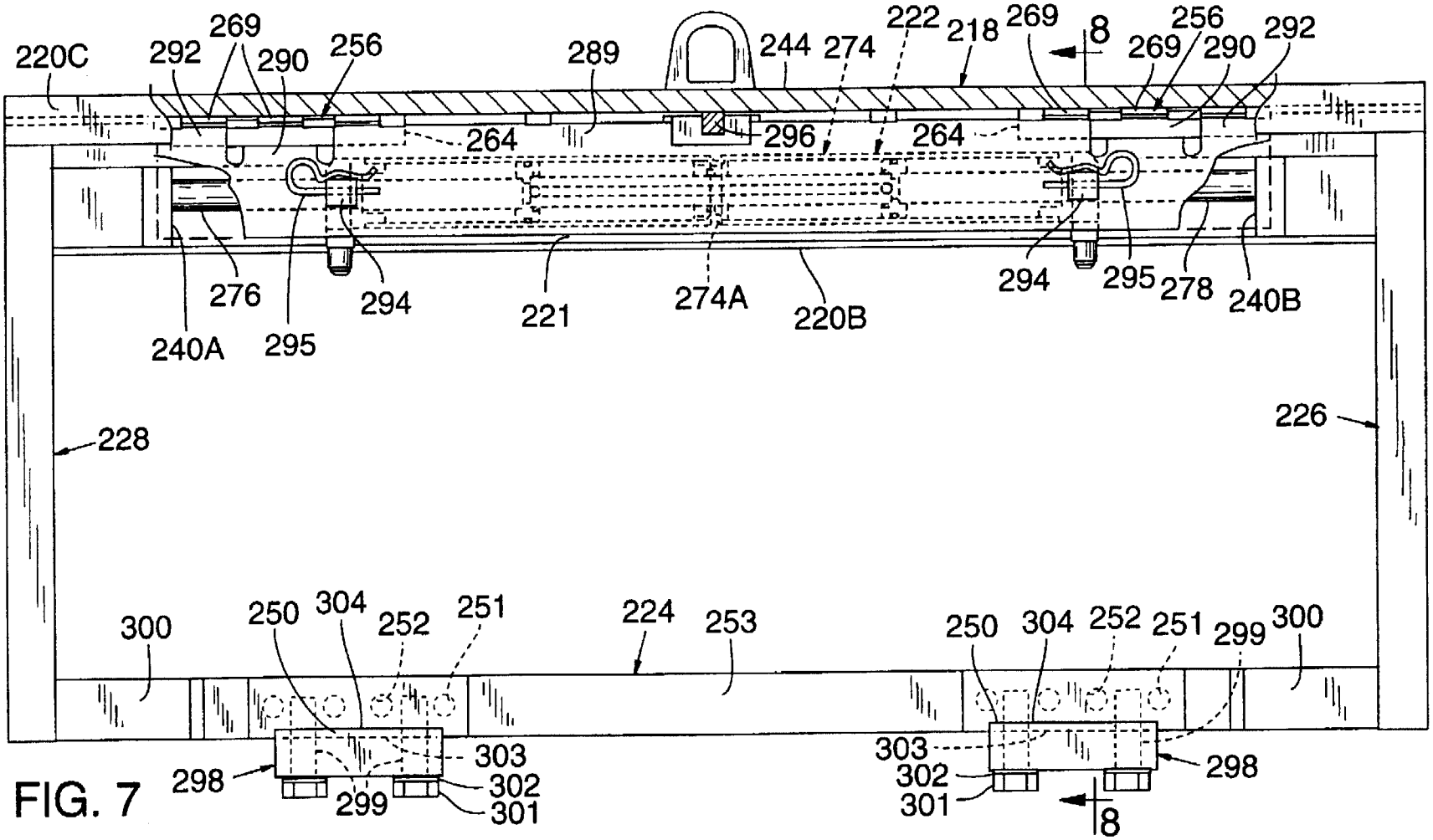
FIG. 7 is a cut-away rear view of the embodiment of FIG. 6.

As shown in FIGS. 6, 7 and 8, the apparatus is assembled and installed so that registration bar 288, bearings 256 and cylinder 274 remain laterally aligned as a unit and fixed relative to truck carriage bars 12 and 112. Frame 218, including clamping feet 298, shifts laterally as a unit in response to actuation of actuator 222, overhang 244 of element 220*c* sliding laterally over fixed bearings 256.

Figure 9:
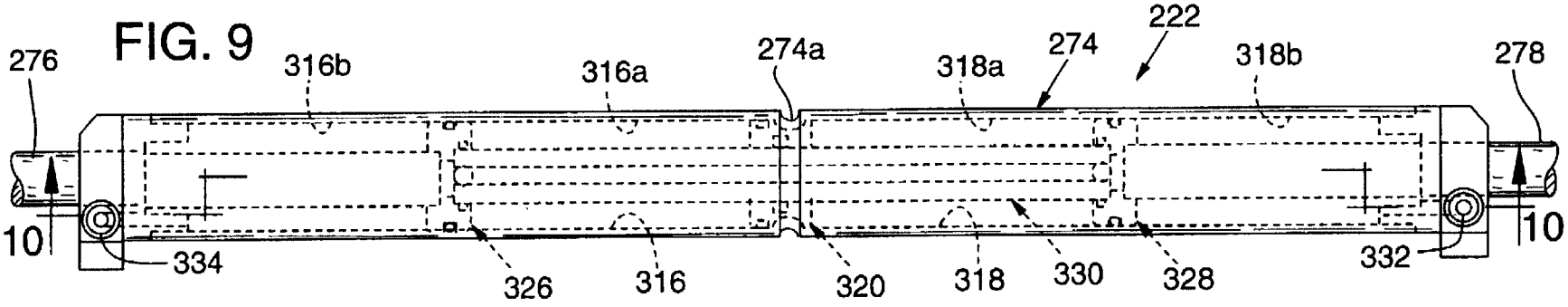
FIG. 9 is a top view of the cylinder incorporated in the embodiment of FIG. 6.
Figure 10:
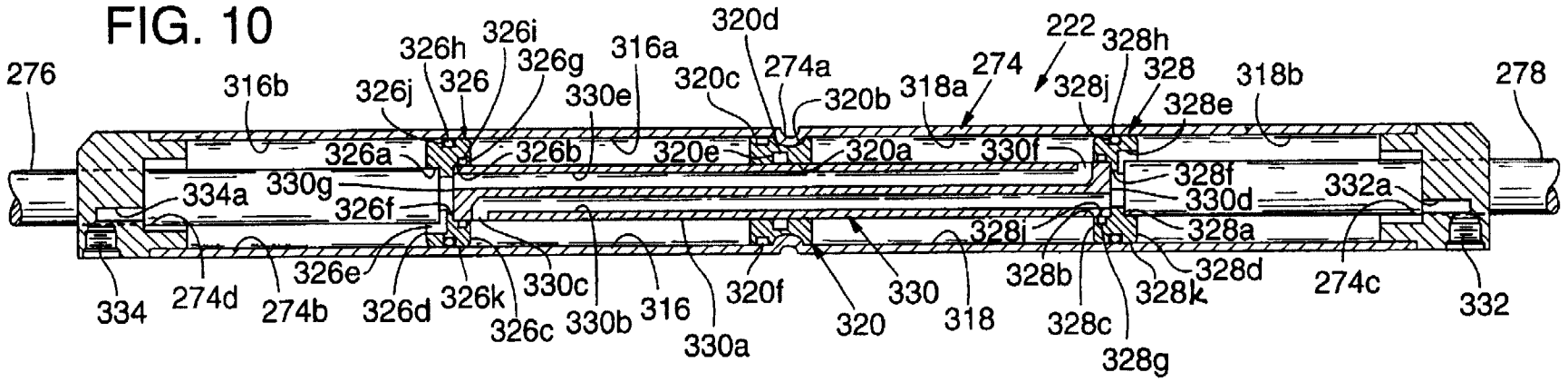
FIG. 10 is a sectional view taken on line 10—10 of the cylinder of FIG. 9.

As in the case of the first embodiment, actuator 222 is designed to provide substantial shifting force using only a relatively small diameter cylinder. Referring to FIGS. 7, 9 and 10, cylinder 274 comprises a left chamber 316 and a right chamber 318 laterally separated by a fixed septum or partition 320 which prevents fluid communication therebetween. Chambers 316, 318 are axially aligned in end-to-end relationship, and have the same diameter and length.

A left piston 326 is slideably disposed within left chamber 316; a right piston 328 is slideably disposed within right chamber 318. Piston 326 defines chamber 316 as having interior and exterior portions **316*a* and 316*b*, respectively; similarly, piston 328 defines chamber 318 as having interior and exterior portions 318*a* and 318*b***, respectively.

A left push rod 276, comprising a solid cylindrical rod, is disposed within exterior portion **316*b* of left chamber 316, being received within a corresponding cylindrical recess 326*a* in the exterior face 326*d* of piston 326. Rod 276, however, unlike piston rod 76 in the first embodiment, is not permanently attached to piston 326, but merely abuts piston 326 within recess 326*a*. Similarly, a right push rod 278, also comprising a solid cylindrical rod, is disposed within exterior portion 318*b* of right chamber 318, being received within a corresponding cylindrical recess 328*a* in the exterior face 328*d* of piston 328. Rod 278 is also not permanently attached to piston 328, but merely abuts piston 328 within recess 328*a***.

A central cylindrical push rod 330, which serves also to transmit hydraulic fluid under pressure, is disposed within the interior portions **316*a* and 318*a* of chambers 316 and 318, respectively. Rod 330 is not attached to either of pistons 326 or 328, but merely abuts them, being received within interior cylindrical recesses 326*b* and 328*b* in the interior faces 326*c* and 328*c* thereof. Rod 330 is adapted to slide within a cylindrical aperture 320*a* in fixed partition 320**.

Cylinder 274 is provided with an annular depression **274*a*, received within a corresponding depression 320*b* in the exterior surface 320*c* of partition 320, to fix partition 320 laterally with respect to cylinder 274. An interiorly disposed O-ring 320*d*, received within an annular recess 320*e* in aperture 320*a*, provides a seal with the exterior surface 330*a* of central push rod 330; an exteriorly disposed O-ring 320*f* received within the exterior surface 320*c* of partition 320 provides a seal with the interior surface 274*b* of cylinder 274. O-rings 320*d* and 320*f* prevent fluid communication between left and right chambers 316 and 318**, as in the case of the first embodiment.

Hydraulic fluid is introduced into chambers 316, 318 as follows. A first hydraulic connection 332 is provided to introduce hydraulic fluid into one (the right) side **274*c* of cylinder 274; and a second hydraulic connection 334 is provided to introduce hydraulic fluid into the other (the left) side 274*d* of cylinder 274**.

Again, referring to FIGS. 7, 9 and 10, application of hydraulic pressure to connection 332, with release of pressure at connection 334, forces hydraulic fluid through passage **332*a* into exterior portion 318*b* of chamber 318, acting on the exterior face 328*d* of piston 328; thence through aperture 328*e* in piston 328 into central passage 328*f* therein; thence into longitudinal passage 330*b* in central push rod 330 to egress from aperture 330*c* at the left end thereof into interior portion 316*a* of chamber 316, against interior face 326*c* of piston 326**.

Again, as in the case of the first embodiment, fluid communication between chambers 316 and 318 is prevented. Passage **330*b* in central push rod 330 transmits hydraulic fluid from exterior portion 318*b* of chamber 318 to interior portion 316*a* of chamber 316; there is no fluid communication between interior portions 316*a* and 318*a* of chambers 316 and 318**, respectively.

This arrangement causes piston 328 to push against the right end **330*d* of central push rod 330, thereby transmitting pressure against recess 326*b* in interior face 326*c* of piston 326 and thence against push rod 276. The hydraulic fluid transmitted through passageway 330*b* into interior portion 316*a* of chamber 316 independently forces piston 326 against push rod 276. In this manner pistons 328 and 326 effectively transmit pressure simultaneously to push rod 276, which abuts plate 240*a* underneath upper shifter bar 220, thereby forcefully shifting frame 218 to the left. It should be noted that this arrangement transmits twice as much force through push rod 276 to plate 240*a* as would be the case if there were only one piston within cylinder 274**.

Similarly, application of hydraulic pressure to connection 334, with release of pressure at connection 332, forces hydraulic fluid through passage **334*a* into exterior portion 316*b* of chamber 316 acting on the exterior face 326*d* of piston 326; thence through aperture 326*e* in piston 326 into central passage 326*f* therein; thence into longitudinal passage 330*e* in central push rod 330 to egress from aperture 330*f* at the right end thereof into interior portion 318*a* of chamber 318, against interior face 328*c* of piston 328. Passage 330*e* in central push rod 330 transmits hydraulic fluid from exterior portion 316*b* of chamber 316 to interior portion 318*a* of chamber 318; there is no fluid communication between interior portions 316*a* and 318*a* of chambers 316 and 318**, respectively.

Inasmuch as fluid communication between chambers 316 and 318 is prevented, piston 326 is caused to push against the left end **330*g* of central push rod 330, thereby transmitting pressure against recess 328*b* in interior face 328*c* of piston 328 and thence against push rod 278. The hydraulic fluid transmitted through passageway 330*e* into interior portion 318*a* of chamber 318 independently forces piston 328 against push rod 278. In this manner pistons 326 and 328 effectively transmit pressure simultaneously to push rod 278, which abuts plate 240*b* under upper shifter bar 220, thereby forcefully shifting frame 218 to the right. Again, this arrangement transmits twice as much force through push rod 278 to plate 240*b* as would be the Case if there were only one piston in chamber 274**.

Pistons 326 and 328 are each provided with interior and exterior O-rings **326*g* and 326*h*, and 328*g* and 328*h*, respectively, such rings being disposed within annular recesses 326*i* and 326*j*, and 328*i* and 328*j*, respectively, in interior recesses 326*b* and 328*b*, and exterior surfaces 326*k* and 328*k* of pistons 326 and 328** to prevent transmission of hydraulic fluid past the respective pistons except as hereinabove described.

Having illustrated and described the principles of the invention in two preferred embodiments, it should be apparent to those skilled in the art that the illustrated embodiments may be modified without departing from such principles. I therefore claim as my invention not only the illustrated embodiments, but all such modification, variations, and equivalents thereof as come within the spirit and scope of the following claims.

I claim:

1. In a fork lift truck apparatus including vertically spaced, horizontally oriented, upper and lower truck carriage bars, a side shifter attachment movably mounted on said truck carriage bars, comprising:

a pair of vertically spaced, horizontally oriented upper and lower shifter carriage bars and a pair of horizontally spaced, vertically oriented side bars connected to said upper and lower shifter carriage bars thereby forming a rectangular open frame;

said upper shifter carriage bar including a first element having a downwardly open, elongated, rearwardly overhanging portion for mounting the side shifter attachment to the upper truck carriage bar, a second element having upper and lower surfaces, at least a portion of said upper surface including an upwardly projecting lip with a plurality of notches therein to supportingly receive lift forks thereon, said first element being connected to said second element on the upper rear surface of the latter, said lip and notches being located forwardly of said first element, a third element having a vertical portion and a horizontal portion that define a substantially J-shaped member, the uppermost end of the vertical portion of said J-shaped member being connected to said second element at a front edge of said lower surface, said second and third elements defining a rearwardly open channel along substantially the entire length of the upper shifter carriage bar;

a pair of abutment means mounted on one of said second and third elements of said upper shifter carriage bar near each end thereof for receiving a force to laterally move the side shifter attachment relative to said truck carriage bars;

a fluid actuator located within said rearwardly open channel defined by said second and third elements of said upper shifter carriage bar, said fluid actuator comprising:

a single cylinder, a partition centrally located in said cylinder thereby dividing the cylinder into a first chamber and a second chamber, a first piston mounted in said first chamber thereby dividing said first chamber into first interior and exterior chamber portions, a second piston mounted in said second chamber thereby dividing said second chamber into second interior and exterior chamber portions, a pair of rod means each operatively associated with a respective piston, each of the rod means including an inner and an outer end, the inner end of each respective rod means being located in the exterior chamber portion of the respective first and second chambers, the respective outer ends of said rod means operatively engaging said abutment means to exert a force thereto to laterally move the side shifter attachment relative to the truck carriage bars;

an elongated registration bar fixedly mounted on said upper truck carriage bar; and means for operatively mounting the ends of the cylinder to said registration bar.

* * * * *